US009066568B2

(12) United States Patent
Serres-Vives et al.

(10) Patent No.: US 9,066,568 B2
(45) Date of Patent: Jun. 30, 2015

(54) PORTABLE APPARATUS FOR THE STEAM TREATMENT OF HAIR

(75) Inventors: Gérald Serres-Vives, Bois d'Arlod (FR); Bénédicte Simond, Marcellaz-Albanais (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 12/681,309

(22) PCT Filed: Oct. 2, 2008

(86) PCT No.: PCT/FR2008/001375

§ 371 (c)(1), (2), (4) Date: May 26, 2010

(87) PCT Pub. No.: WO2009/077674

PCT Pub. Date: Jun. 25, 2009

(65) Prior Publication Data

US 2010/0224206 A1 Sep. 9, 2010

(30) Foreign Application Priority Data

Oct. 3, 2007 (FR) ..... 07 06927

(51) Int. Cl.

| | |
|---|---|
| ***A45D 1/04*** | (2006.01) |
| ***A45D 2/00*** | (2006.01) |
| *A45D 2/36* | (2006.01) |
| *A45D 1/28* | (2006.01) |
| *A45D 1/00* | (2006.01) |

(52) U.S. Cl.

CPC ... *A45D 1/04* (2013.01); *A45D 2/36* (2013.01); *A45D 1/28* (2013.01); *A45D 2/001* (2013.01); *A45D 2001/008* (2013.01)

(58) Field of Classification Search

None

See application file for complete search history.

(56) References Cited

U.S. PATENT DOCUMENTS

| | | | | | |
|---|---|---|---|---|---|
| 1,738,916 | A | | 12/1929 | Murray | |
| 1,847,735 | A | * | 3/1932 | van Kirk | 132/206 |
| 3,781,519 | A | | 12/1973 | Martin et al. | |
| 3,947,659 | A | * | 3/1976 | Ono | 392/404 |
| 4,114,022 | A | | 9/1978 | Braulke, III | |
| 4,166,473 | A | * | 9/1979 | Bauer et al. | 132/272 |
| 4,341,229 | A | * | 7/1982 | Bauer et al. | 132/211 |
| 4,479,047 | A | * | 10/1984 | Khaja et al. | 219/225 |
| 4,632,133 | A | * | 12/1986 | Losenno | 132/231 |
| 4,829,156 | A | * | 5/1989 | Thompson | 219/225 |
| 4,911,185 | A | * | 3/1990 | Losenno | 132/211 |
| 5,119,847 | A | * | 6/1992 | Powell et al. | 132/226 |
| 5,263,501 | A | * | 11/1993 | Maznik | 132/211 |
| 5,649,555 | A | * | 7/1997 | Harris | 132/238 |

(Continued)

FOREIGN PATENT DOCUMENTS

| | | | |
|---|---|---|---|
| CN | 1627906 | A | 6/2005 |
| CN | 2715596 | A | 8/2005 |

(Continued)

*Primary Examiner* — Joseph M Pelham

(74) *Attorney, Agent, or Firm* — The Webb Law Firm

(57) ABSTRACT

A portable apparatus for the steam treatment of hair, comprising a housing including a liquid tank, and a means for supplying a steam generator with liquid having a vaporization chamber in thermal contact with an electric heating member, the vaporization chamber communicating with one or more openings for dispensing steam towards a lock of hair. The generator is supplied with liquid by an electric pump, and the flow rate of the steam thus generated is higher than 5 g/min, and preferably of between 10 g/min and 60 g/min.

17 Claims, 5 Drawing Sheets

(56) References Cited

U.S. PATENT DOCUMENTS

| | | | | |
|---|---|---|---|---|
| 5,781,691 | A * | 7/1998 | Kwok | 392/405 |
| 6,119,702 | A * | 9/2000 | Habibi | 132/224 |
| RE38,713 | E * | 3/2005 | Habibi | 132/224 |
| 6,941,955 | B2 | 9/2005 | Yao | |
| 7,178,531 | B2 * | 2/2007 | Carballada et al. | 132/224 |
| D541,472 | S * | 4/2007 | Kuchler et al. | D28/35 |
| 7,380,556 | B2 * | 6/2008 | Carballada et al. | 132/224 |
| 7,465,904 | B2 * | 12/2008 | Kim et al. | 219/222 |
| 8,028,708 | B2 * | 10/2011 | Molema et al. | 132/292 |
| 2003/0127105 | A1 * | 7/2003 | Fontana | 132/200 |
| 2004/0000319 | A1 * | 1/2004 | Carballada et al. | 132/224 |
| 2004/0003824 | A1 * | 1/2004 | Habibi | 132/224 |
| 2004/0045570 | A1 | 3/2004 | Yao | |
| 2005/0061352 | A1 | 3/2005 | Yao | |
| 2006/0108344 | A1 * | 5/2006 | Kim et al. | 219/225 |
| 2006/0144414 | A1 * | 7/2006 | Carballada et al. | 132/224 |
| 2008/0283080 | A1 * | 11/2008 | Habibi | 132/224 |
| 2009/0188516 | A1 * | 7/2009 | Catini | 132/269 |
| 2010/0212684 | A1 * | 8/2010 | Han | 132/232 |

FOREIGN PATENT DOCUMENTS

| | | | |
|---|---|---|---|
| EP | 1652445 | A1 | 5/2006 |
| EP | 1967088 | A1 | 9/2008 |
| WO | 2004002262 | A1 | 1/2004 |

* cited by examiner

PORTABLE APPARATUS FOR THE STEAM TREATMENT OF HAIR

BACKGROUND OF THE INVENTION

1. Field of the Invention

The present invention relates to a portable apparatus for the treatment and/or shaping of hair employing means for generating steam, possibly in conjunction with a shaping device provided for untangling, styling, or setting hair in connection with steam.

2. Description of Related Art

Apparatuses for the steam treatment of hair are known to the prior art, such as disclosed in U.S. Pat. No. 5,263,501, in which the apparatus is a curling iron consisting of a housing bearing a mandrel having a conical base fastened to the housing and projecting to form a cylindrical tip section equipped with peripheral steam outlet openings. The conical base receives the steam from a generator associated with the housing, and the steam then follows the longitudinal axis of the mandrel towards the outlet openings thereof. The cylindrical section is inserted in a curler on which the hair is wound and then steam treated in that state. A disadvantage resides in this apparatus in that the steam transfer takes place remotely from the steam outlet opening of the generator, which results in load losses and hence a diminished steam outflow. Furthermore, such an arrangement of the steam outlet remotely from the generator also leads to condensation. As a result, aside from the reduced steam yield, a return pipe must be provided to the tank, which in turn complicates the construction of the apparatus. Furthermore, because the water is supplied to the tank inside the generator by means of a hand pump, the steam chamber is often flooded, particularly when the person using the apparatus and wanting a greater steam flow presses the pump trigger too often. This results not only in a very irregular steam flow but also water discharges, which are annoying and even hazardous to the person using the apparatus.

To remedy these disadvantages, the document WO 2004/002262 describes a solution in which the apparatus is a flat iron consisting of two jaws that are elastically jointed at one of their ends. According to this document, the steam generating means form a sandwich structure, which is contained in one of the jaws. More particularly, one jaw has a tank for the treatment liquid, which impregnates a lock placed in contact with the heating element of the jaw for vaporizing said liquid, which then passes through openings provided for this purpose in the treatment surface designed to contact the hair. Although this device generates a more stable steam flow than the apparatus of the preceding document, the main disadvantage of this apparatus resides in the fact that, in spite of its rather complicated structure, it only generates a very weak steam flow, notably less than 2 g/min. A treatment performed with such a steam flow does not produce any observable effects on the hair, which must then be subjected to a supplementary, rather powerful heat treatment in order to give it a certain style, and of which the very high temperature dries out the hair and may damage it.

The object of the present invention is to remedy, at least partially, these disadvantages and to propose a hair shaping apparatus capable of delivering a continuous, uniform supply of steam suitable for a thorough and effective hair treatment, which also possesses a simple construction and is safe to operate.

Another object of the invention is a hair treatment apparatus designed for rapidly delivering a regulated supply of steam to the hair being treated, which can also be disconnected from a possible supplementary source of heat and/or mechanical tensioning and/or chemicals.

Another object of the invention is a steam hair shaping apparatus which is reliable in operation, which is designed to avoid condensation, and which can be manufactured easily and economically.

SUMMARY OF THE INVENTION

These objects are achieved with a portable steam hair treatment apparatus comprising a housing consisting of a liquid tank, means for supplying liquid to a steam generator comprising a vaporization chamber in thermal contact with an electric heating element, the vaporization chamber communicating with one or a plurality of openings for dispensing the steam to a lock of hair, wherein the generator is supplied with liquid by an electric pump and wherein the flow rate of the steam provided is greater than 5 g/min, and preferably in a range of between 10 g/min and 60 g/min.

Such a steam generator fed by an electric pump makes it possible to supply a significant flow of steam quickly, uniformly, and continuously to the lock of hair being treated, hence resulting in a durable and thorough treatment of the latter. By using an electric pump in which the maximum flow supplied is advantageously calculated as a function of the maximum heating power of the vaporization chamber, the liquid introduced into the chamber by the pump is immediately and completely turned into steam, thus preventing a discharge of non-vaporized liquid droplets from the dispensing openings. Furthermore, such an apparatus is portable, thus enabling the steam outlet to be arranged as closely as possible to the steam generation elements of the housing in order to eliminate condensation, while simplifying the construction of the apparatus and making it easier to manipulate.

In performing laboratory tests with a steam flow greater than 5 g/min and capable of going as high 100 g/min on locks of hair, either in the natural state or coated with cosmetics, it was observed that the effect of the treatment was clearly visible on the treated lock, as the hair had already been well prepared for a subsequent treatment by a strong steam flow, which had, for example, cleaned and uniformly moisturized it. This effect persisted even on locks subsequently treated with a hair shaping device employing a mechanical action and/or heat, because the hair that had already been moisturized in a more controlled manner retained its shaping for a longer time, with remarkable results in terms of its appearance, particularly sheen and color, which were uniform throughout.

By performing the same tests on several types of locks, it was observed that the flow range of between 10 g/min and 60 g/min gave the best results in terms of opening scales and moisturizing the hair for most of the hair types analyzed.

Advantageously, the dispensing opening or openings are arranged on one of the ends of the housing of the apparatus, and the latter comprises a deflector oppositely arranged relative to the dispensing opening or openings.

This deflector functions as a steam shield by being oppositely positioned relative to the steam outlet, while leaving a space to accommodate a lock of hair. On one hand, this deflector makes it possible to protect to the scalp of the person receiving the treatment and on the other hand, to redirect the steam to the back of the lock and thus treat it on both of its sides with a steam outlet located on only one of its sides.

Preference is given to the power of the electric heating element being in the range of between 600 W and 1000 W.

This makes it possible to increase the temperature in the vaporization chamber rapidly to around 150° C. for vaporizing, preferably instantaneously, the liquid introduced into the chamber by the pump.

Advantageously, the steam generator consists of a bottom plate equipped with a liquid intake opening and at least one outlet opening for the steam generated, and of a top plate, wherein the steam is made to circulate between the two plates by at least one baffle circuits having a length in the range of between 100 mm and 200 mm.

Such baffle circuits make it possible to increase the contact time and to vary the displacement direction of the liquid in contact with the hot wall of the generator and to improve appreciably the heat transfer during boiling. The vaporization chamber is thus superheated, and all of the water droplets carried by the flow are vaporized before they reach the steam outlet openings of the chamber.

Preference is given to the apparatus comprising one or a plurality of pipes connecting the outlet of the vaporization chamber to the dispensing opening or openings, wherein each pipe is less than 3 cm long.

The vaporization chamber is thus positioned as closely as possible to the steam dispensing or outlet openings, hence making it possible to steam treat the lock of hair directly from the outlet of the vaporization chamber via one or a plurality of pipes. As these steam pipes exiting the vaporization chamber are very short in length, they dispense the steam in such a way that condensates cannot form, which could otherwise interfere with and/or cancel the action of the steam on the lock or impair the utility of the apparatus, as the condensates in a worst case scenario could burn the person who is using the apparatus or is receiving the treatment.

Advantageously, the apparatus has a control device for regulating the flow rate of liquid supplied to the generator.

Such a device for regulating the flow rate of liquid supplied by the pump to the vaporization chamber makes it possible to adapt the flow rate of the steam generated according to the type of treatment and/or to the type of hair being treated with the apparatus.

In a preferred embodiment of the invention, the apparatus has a hair shaping device comprising at least one treatment surface generally elongate in shape and coming into contact with a lock of hair, and said steam dispensing openings are adjacent to the hair shaping device.

A hair shaping device is understood to mean a device designed to come into contact with hair, at least temporarily and/or locally, in order to untangle it, style it or simply keep it in contact with a treatment surface such as, for example: a comb, a cylinder impregnated with a hairstyling product, such as a coloring agent, a flat iron with jointed mobile or fixed arms, a curling iron with a cylindrical heating mandrel possibly cooperating with at least one heating plate oppositely arranged relative thereto, a straightening head comprising a plurality of parallel treatment surfaces arranged side by side, etc.

The direction of the hair shaping is generally defined by the generally elongate treatment surface of the hair shaping device, a surface that generally treats the width of a lock with its longest side. By arrangement of the dispensing openings in the vicinity of the edge of the hair shaping device, the steam is prevented from reaching the interior of the device, thus effectively separating the steam treatment function from another hair shaping function such as, for example, a treatment involving the application of heat and/or tension or pressure to the hair, and/or a hairstyling product such as a fixation agent, etc., for an improved result on the lock being treated.

Advantageously, the steam path is defined via a plurality of openings uniformly distributed parallel to the treatment surface of the hair shaping device, which aim the steam in a direction perpendicular to that of their hair shaping by said device.

A steam path arriving perpendicular to the width of a lock of hair hence enables a quick and moreover, a homogeneous treatment of the lock when the steam is dispensed by outlet openings covering the width of the lock.

In a first alternate embodiment of the invention, the dispensing openings are adjacent to the hair shaping device and disposed upstream relative thereto.

"Upstream" is understood to mean that, in the treatment operation, a portion of the lock of hair first undergoes the steam application before undergoing the shaping treatment.

Tests performed by treating a lock of hair with steam emitted upstream of the hair shaping device have shown that the steam opens the scales of the hair and thoroughly cleans it. The mechanical action subsequently exerted by the hair shaping device rids the hair of any remaining impurities, such as those from an earlier treatment and/or care process.

The laboratory tests also showed that the steam emitted upstream of the hair shaping device, when the latter comprises a cosmetic dispensing system, enhances the penetration of said cosmetic into the interior of the hair, thus improving the deep-penetrating action of said cosmetic.

It has also been observed that treating the lock of hair with a device exerting a thermal action in addition to the mechanical action after the steam application keeps the hair from drying out, as the hair is pre-coated with a layer of moisture. Obviously this layer is vaporized during the styling process, but it, rather than the water contained in the core of the hair, is vaporized, thus protecting the hair from any desiccation linked to the application of a hot hair shaping device.

Lastly, the laboratory tests also showed that the steam emitted upstream of the hair shaping device sufficiently moisturizes the hair, thus protecting it from significant desiccation during the action of the hair shaping device, which may be heated to a high temperature, for example, 230° C.

In a second alternate embodiment of the invention, said dispensing openings are adjacent to the hair shaping device and disposed downstream thereof.

"Downstream" is understood to mean that, in the treatment operation, a portion of the lock of hair first undergoes the shaping treatment before undergoing the steam application.

Tests performed with an apparatus configured according to this variant of the invention have shown that, after a mechanical shaping of the lock, the steam remoisturizes the hair to compensate for the desiccation linked to the application of the hot treatment surface of a shaping device on the hair.

Preference is given to the hair shaping device comprising at least one electric heating element in thermal contact with the treatment surface.

Such a device comprising its own heating element independent from that of the steam generator enables the achievement of a durable hair shaping, for example a straightening, curling, or crimping. When steam is applied to a lock of hair after it has been shaped by a device exerting a thermal action, even in combination with a mechanical action on the lock, the steam remoisturizes the hair in order to compensate for the desiccation linked to the application of a hot instrument to the hair.

Preference is given to the hair shaping device having controls independent from those for the steam.

This makes it possible to separate the two functions, hence enabling the operating parameters for each function to be adjusted independently.

Advantageously, the housing comprises a body that extends downwards to form a handle, wherein the hair shaping device is oppositely arranged relative to the handle and the steam path exiting from the dispensing openings is aligned along the longitudinal axis of the body of the housing.

Such a configuration of the housing ensures both ergonomic use and effective treatment of the hair by the steam.

In a preferred embodiment of the invention, the hair shaping device has two jointed arms displaceable in opposite directions and in each case having a hair treatment surface, wherein at least one of the arms has a heating element in thermal contact with said treatment surface.

Such a device ensures an effective, long-lasting straightening of the hair.

Advantageously, the hair shaping device is detachable from the housing of the apparatus.

This constitutes a simple and economical means for enabling the apparatus to be used with the same hair shaping device or even with a plurality of hair shaping devices by either a right-handed or a left-handed person.

This also makes it possible to apply steam alone, without shaping beforehand or afterwards. In this case, the steam shield is integrated with the body of the apparatus and not with the hair shaping device.

Preference is given to the liquid in the tank being a treatment product.

Treatment liquid is understood to mean any liquid capable of being vaporized by the generator and then capable of being applied to the hair in vapor form for care, shaping, colorization, de-colorization, etc. This liquid is water in a preferred embodiment of the invention.

In another embodiment of the invention, the apparatus has a supplementary liquid tank adjacent to or associated with the hair shaping device.

This supplementary tank may thus be associated with either the apparatus or the hair shaping device and it allows a liquid that is not necessarily vaporized by the steam generator of the apparatus to be applied to the hair, for example, during an application in which the liquid from the supplementary tank is brought into contact with the treated lock.

Advantageously, the liquid contained in the supplementary tank is different from the liquid contained in the tank for supplying the steam generator.

This makes it possible to apply a cosmetic liquid, such as a hairstyling or colorization agent, in addition to the steam treatment.

Hence, in the case wherein the cosmetic was applied prior to the steam application, the steam serves as a transport medium for the cosmetic, enabling it to penetrate to the core of the hair via the opening of the scales, wherein the subsequent mechanical treatment closes the scales again and performs a type of cauterization of the hair to fix the cosmetic.

Furthermore, in the case wherein the cosmetic was applied after the mechanical and thermal treatment of the hair, the steam is used as a transport medium, thus protecting the cosmetic from exposure to very high temperatures and from thermal degradation.

BRIEF DESCRIPTION OF THE DRAWINGS

The invention will become more clear by studying a special embodiment of the invention and its variants, which are in no way limiting and which are illustrated in the appended figures, wherein.

DETAILED DESCRIPTION OF THE INVENTION

Figure 3A:
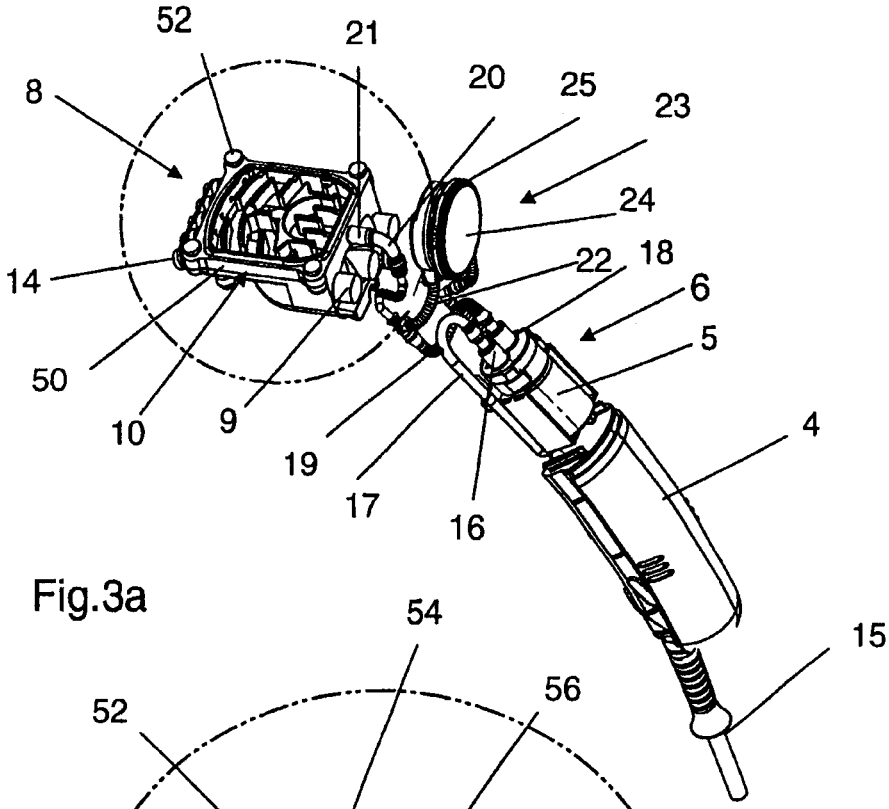
FIG. 3*a* is a perspective view of the apparatus of FIG. 1 without the hair shaping device, the housing and the cover of the vaporization chamber having been removed from the apparatus.
Figure 4:
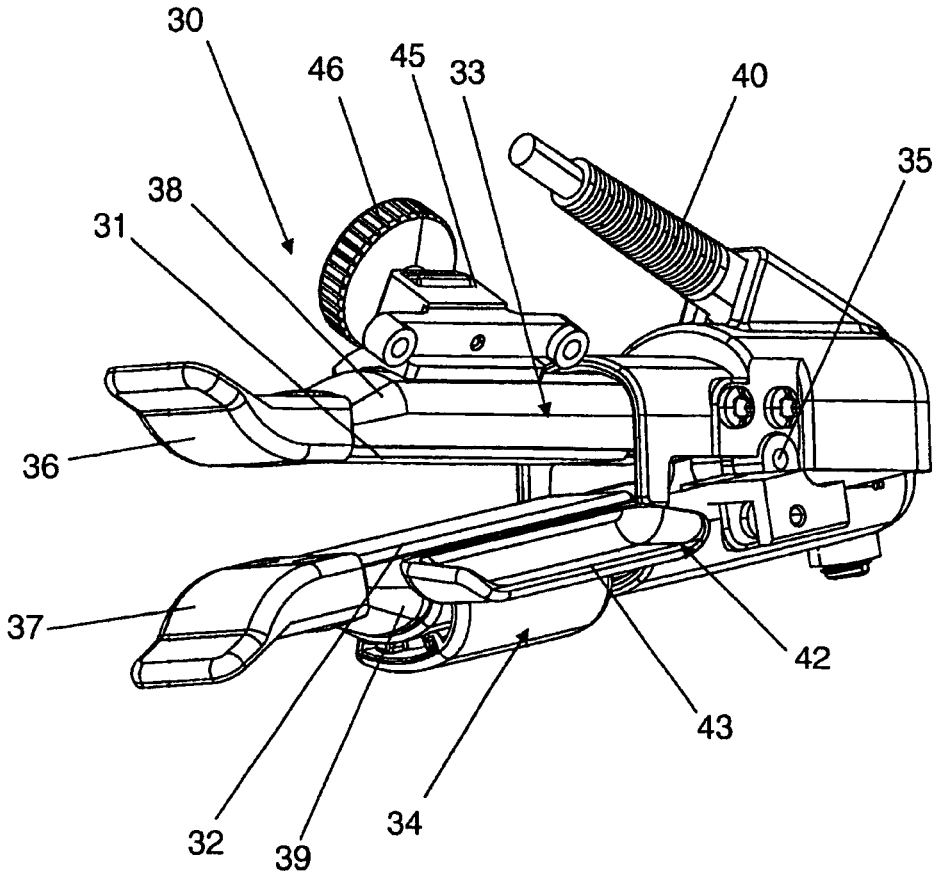
FIG. 4 is a perspective view of a hair shaping device of the apparatus of FIGS. 1 and 2.

The appended figures, except for FIG. 4, illustrate a portable apparatus for the steam treatment of hair consisting of a plastic housing 1 comprising a body 2 with a downwardly projecting extension forming a handle 3 receiving a detachable water tank 4 of which the top wall forms the top part of the handle. The extension of the housing 1 also contains means for supplying power 6 (FIG. 3*a*) to a steam generator 8 contained in the body 2 of the housing 1. The steam generator 8 consists of a chamber 10 for, e.g., instantaneous vaporization associated with an electric heating element 9; said elements are visible in FIG. 3*a*.

According to the invention, the steam generator is supplied by an electric pump and is configured in such a way as to be able to generate a steam flow greater than 5 g/min, with preference being given to a range of between 10 g/min and 60 g/min.

The supply means 6 in particular comprise an electric pump 5, which can be seen in FIG. 3*a* and which is started by a control switch 7. The circuit connecting the electric pump 5 to the tank 4 and to the generator 8 can also be discerned in FIG. 3*a*. The electric pump 5 hence has an inlet opening 16 connected by a first pipe 17 to the tank 4 and a discharge opening 18 directing the water coming from the tank 4 through a circuit supplying the steam generator 8. More particularly, the circuit supplying the steam generator 8 has a second pipe 19 leading to a junction dividing the supply circuit into a first pipe branch 20 connected to an inlet opening 21 in the vaporization chamber 10 of the steam generator 8 and a second pipe branch 22 connected to the tank 4 and allowing a portion of the water coming from the pump 5 to be piped to the tank 4. The passage of the first pipe branch 20 is smaller than that of the second pipe branch 22, the latter being made of a flexible hose, the apparatus further comprising a mechanism 23 for controlling the flow of the water piped into the generator 8. The control mechanism 23 comprises means for compressing the flexible hose of the second pipe branch 22, which passes through a cylindrical housing 25. More particularly, by turning a knurled knob 24 the control mechanism 23 actuates a toggle lever inside the housing 25, which lever presses on the outer surface of the flexible hose.

When the pump 5 is started by the control switch 7, it sucks the water from the tank 4 via the first pipe 17 and pipes the water via the second pipe 19, the water flow conducted by this circuit thus being divided into a first, weak flow piped to the generator 8 and a stronger flow piped to the tank. The flow of water to the generator 8 can be increased by turning the knob 24 to compress the return hose to the tank 4.

Figure 3B:
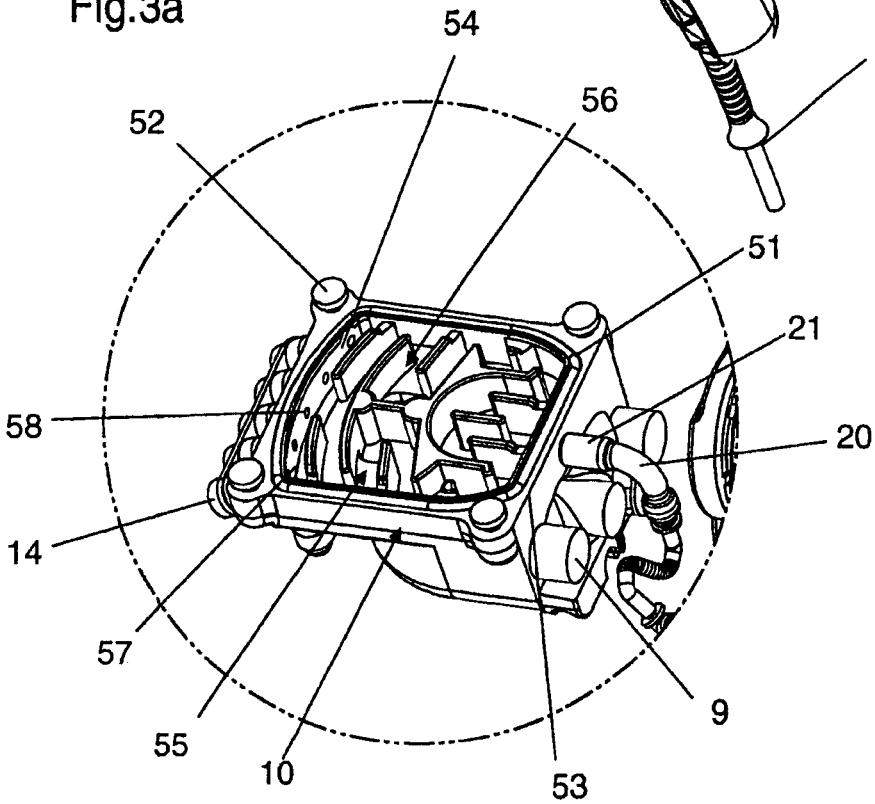
FIG. 3*b* is a magnified view of a detail of FIG. 3*a;*

More particularly according to the invention and as can be discerned more clearly in FIG. 3*b*, the vaporization chamber 10 comprises an enclosed compartment formed between a bottom plate 50 of a general rectangular shape and a top plate (not shown for the sake of greater clarity), wherein the two plates are fastened together on their four corners by screws 52. A silicone gasket 51 disposed between the two plates ensures that the inside of the vaporization chamber 10 is sealed.

The bottom plate 50 is equipped with a plurality of raised sections forming baffles, which ensure that the fluid is directed from a water inlet to the steam outlet openings of the chamber. Water enters the vaporization chamber 10 via the inlet opening 21 located in the middle of a front wall 53. The flow of the incoming water is divided, then the droplets of water and steam are directed by the raised sections of the bottom plate 50 along the two symmetrical, labyrinthine paths 55 and 56, which are arranged on either side of the axis of the chamber passing through the central inlet opening 21. Each of the paths 55, 56 has a length of ca. 150 mm for increasing the heating zone of the chamber, in order to turn the water entering the vaporization chamber 10 into steam. The two paths 55, 56 rejoin each other in a buffer zone 57 located right in front of a back wall 54 of the chamber. The buffer zone 57 forms a dispensing chamber for the steam exiting via the openings 58. In the illustrated example, there are five openings 58 in the back wall 54 that lead to five pipes 14 via five inner nozzles integrally formed with the chamber as a single component. Each pipe 14 is fastened in a leak-proof manner at one of its ends to the outlet of a nozzle and has on its opposite end a spray jet aligned with a dispensing opening 12 of the housing of the apparatus. In addition, the inner walls of the vaporization chamber 10 are covered with a layer formed from a granular coating, which is designed to increase the contact surface between the walls and the water droplets inside the chamber and thus improve the diffusion of the droplets on the heating surface of the chamber. Such a vaporization chamber is capable of instantaneously generating dry steam from the outlet.

The steam generator 8 is constructed from an aluminum or aluminum alloy block possessing good thermal inertia qualities and forming a calorie reservoir for the vaporization chamber 10, enabling rapid vaporization of the water when the pump is turned on. The vaporization chamber 10 and the electric heating element 9 form a monoblock unit. In the example illustrated in the figures, the electric heating element 9 is a 900 W armored resistor. Electrical power is supplied to the apparatus via an electric cord 15, and the power supply to the heating element 9 is controlled by an on/off switch on the apparatus.

The water flowing into the vaporization chamber 10 is rapidly turned into steam by the latter as it flows along the path of the baffles of said instantaneous vaporization chamber 10. The steam exits the vaporization chamber 10 via a plurality of openings formed in a back wall of said vaporization chamber opposite the wall accommodating the inlet opening 21. Each of the steam outlet openings of the vaporization chamber 10 communicates with a pipe 14 for dispensing the steam outside the apparatus. In FIG. 3*b* it is hence possible to discern five short pipes 14, each of which is, for example, ca. 1 cm long, enabling the steam to be dispensed immediately after exiting the vaporization chamber 10.

Figure 1:
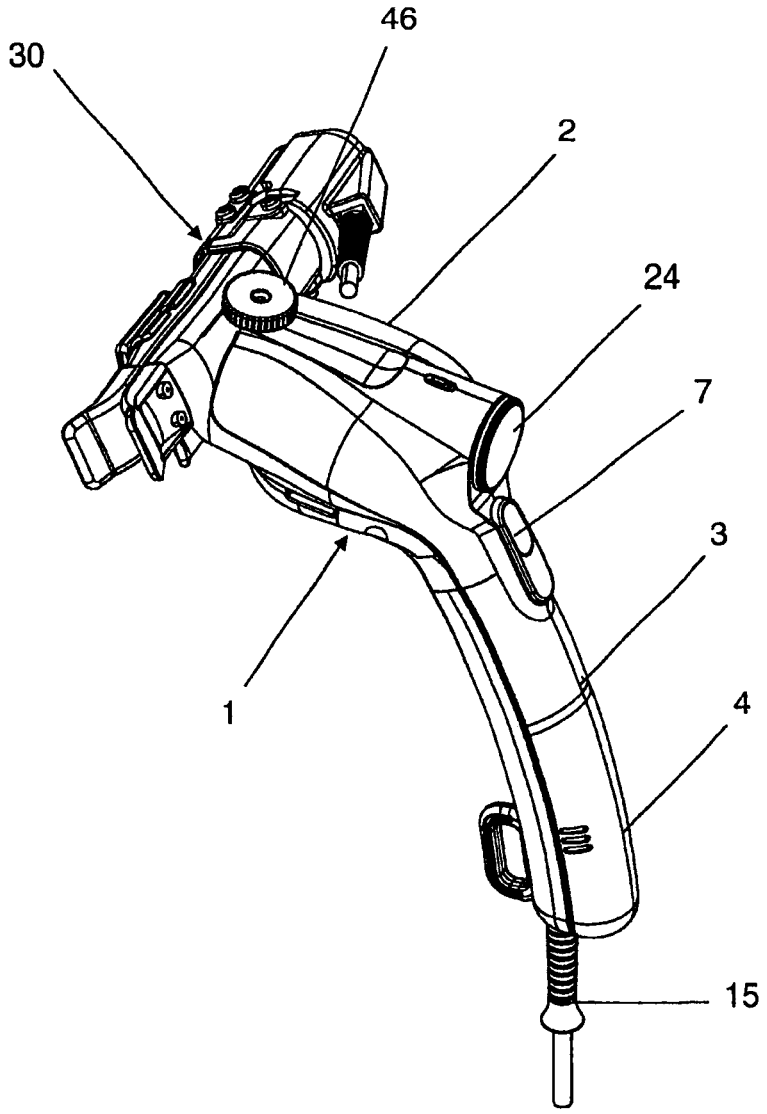
FIG. 1 is a perspective view of a portable apparatus for the steam treatment of hair according to a special embodiment of the invention comprising a hair shaping device illustrated in the closed position.
Figure 2:
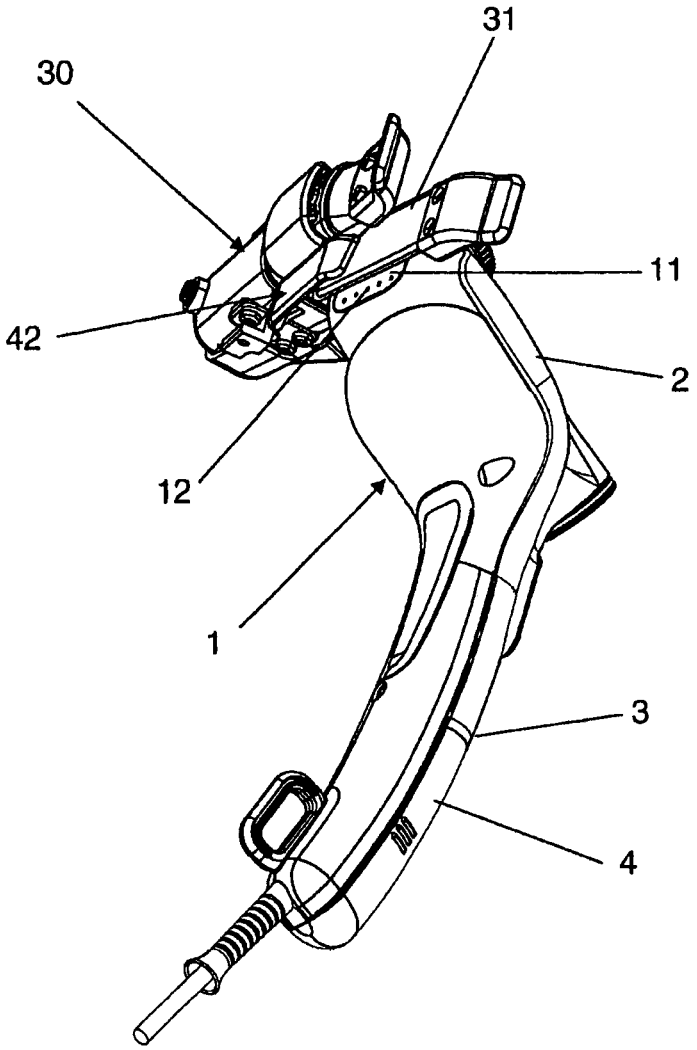
FIG. 2 is a perspective view of the apparatus of FIG. 1, with the hair shaping device in the open position.

As can be discerned more clearly in FIG. 2, the bottom part of the body 2 of the housing 1 on the side opposite the handle 3 is closed by a flat side 11 having a plurality of steam dispensing openings 12, each of which openings communicates with the outlet of a pipe 14.

According to an advantageous aspect of the invention, the steam dispensing openings 12 are adjacent to a hair shaping device 30. Hence the top part of the body 2 advantageously accommodates the hair shaping device 30, the latter having at least one treatment surface 31 located in the extension parallel to, even set back a few millimeters from, the flat side 11 of the housing 1.

The hair-setting device 30 can be more easily discerned in FIG. 4 and it consists of two arms 33, 34 joint-mounted about a hinge 35 and held in an open position, or in a closed position in a variant, by a compression spring (not shown in the drawings). It is hence possible to discern a top arm 33 having, on its free end, a flared insertion shoe 36 that extends to form a flat, rectangular treatment surface 31 in contact with a heating element. On its free end, the bottom arm 34 likewise has a flared insertion shoe 37 that extends to form a flat, rectangular treatment surface 32 in contact with a heating element.

Each treatment surface 31, 32 is constituted by a metal plate that makes thermal contact with an electric heating element (not shown in the drawings), which can be a resistance, CTP, infrared, etc. heating element and which is positioned against the treatment surface and inside the plastic bodies 38 and 39, respectively, of each arm 33, 34. Each electric heating element can have its own control mechanism and is supplied with power by an electric cord 40. Provision is made of the heating element for heating the plates to temperatures ranging from 90° C. to 230° C. In a variant, the apparatus has a single electric cord 15 for supplying electricity to the steam generator 8 and to the heating plates of the hair shaping device 30. The treatment surface 31, 32 is made of a heat conducting material and may be polished, coated with an enamel, a ceramic material, a layer of glass, etc.

The arms 33, 34 are hence elastically mobile and capable of pivoting about an axis perpendicular to the longitudinal axis of their respective treatment surfaces 31, 32 between an open and a closed position. Hence a lock of hair can be inserted between the treatment surfaces 31, 32 of the arms 33, 34 when the arms are in the open position, and the lock can then be subjected to pressure in order to bring it into contact with said treatment surfaces 31, 32 when the arms are in the closed position, which closing is possible by pressing on the outer surface of the bodies 38, 39 of the arms. The flat treatment surfaces 31, 32 thus straighten the lock with which they come into contact.

In an alternate embodiment of the hair shaping device 30, the jaws are closed at rest and it is necessary to introduce the lock manually between the treatment surfaces 31, 32 by stretching it out and then pushing it between the two plates with the aid of the insertion shoes 36, 37. Advantageously, a control mechanism for opening the plates wide enough so that the lock can be more easily inserted is conceivable, wherein said mechanism could be actuated, for example, from the handle or in the vicinity of the handle of the apparatus.

According to an advantageous aspect of the invention, the bottom arm 34 comprises a deflector 42 consisting of a wall 43 arranged set back from, but parallel to the treatment surface 32. The wall 43 forms a steam shield that protects the scalp from the action of the steam while diverting the steam towards the lock being treated. Another advantage of diverting the steam in this manner is that the front and the back of the lock can be impregnated with steam from a steam outlet arranged on just one side.

According to another advantageous aspect of the invention, the top arm 33 has a mounting bracket 45 on the body 2 of the housing 1 of the apparatus, more particularly a fastener that can be detached by means of a screw 46 cooperating with a threaded borehole in the top part of the body 2 of the apparatus. This detachable fastener makes it possible, by unscrewing the screw 46, to switch from a positioning that is suitable for use by a right-handed person, as shown in the figures, to another positioning wherein the device is rotated 180° about the longitudinal axis of the body 2 for enabling a left-handed person to use the apparatus. This hair shaping device can be replaced by another device, such as one comprising a cylindrical curling element cooperating with a pivoting fastening clip for the hair, with this device then being inserted in the mounting bracket 45 and attached to the body 2 of the housing 1 of the apparatus. The detachable fastener for the hair shaping device 30 also makes it possible to use the steam treatment apparatus alone, without a hair shaping device attached to its steam-emitting end.

Figure 5:
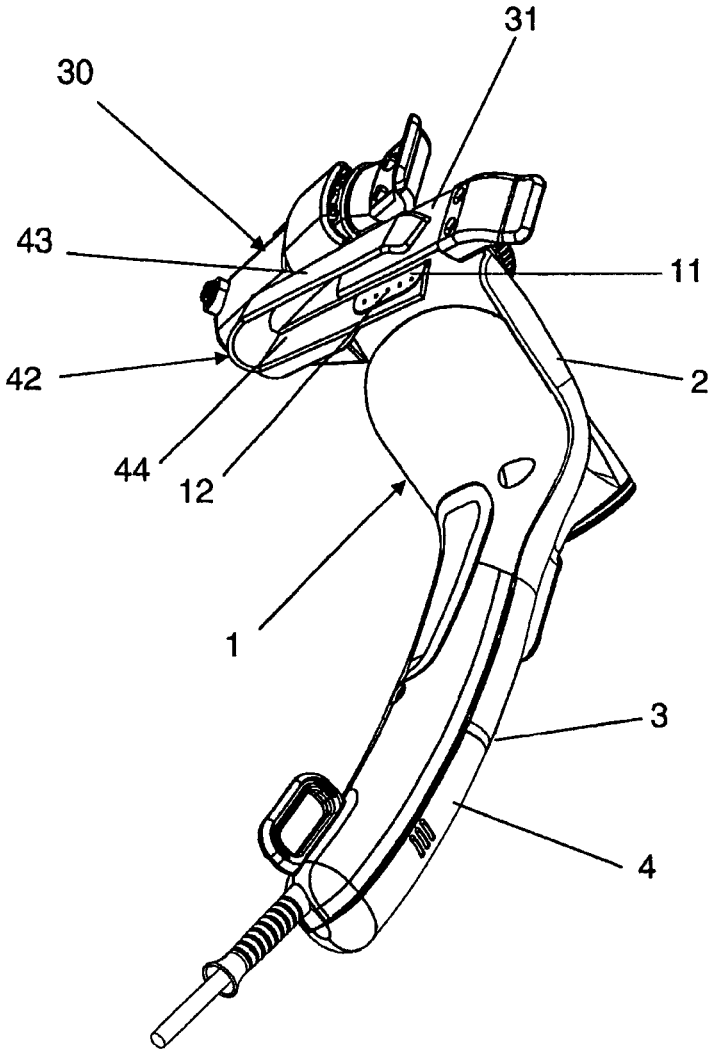
FIG. 5 is a perspective view of the apparatus for the steam treatment of hair according to a variant of the embodiment of the apparatus of FIG. 1.

FIG. 5 illustrates an alternate embodiment of the deflector 42, notably by solidly connecting it to the body 2 of the housing 1 of the apparatus. More particularly, the deflector 42 has the general shape of a tuning fork and comprises a back wall 44 penetrated by dispensing openings 12 and extending to form an elbow connecting it to a deflection wall 43 spaced apart from said back wall. The deflection wall 43 is disposed remotely from and parallel to the back wall 44 and ends in a tip that curves back towards the latter. Such a deflector allows a lock of hair to pass between its parallel walls while protecting the scalp, and at the same time ensures that the steam is directed to the lock via the deflection wall. Advantageously, such a deflector can be made of plastic. The apparatus of FIG. 5 can be used alone for hair treatments, as the hair shaping device 30 is detachable.

In operation, the hair shaping device 30 is turned on by pressing a control switch, and a light (not shown in the drawings) can indicate when the heating plates have reached the correct temperature. A lock of hair is then introduced between the arms 33, 34 of the hair shaping device 30 applying a pressure force to the lock, then the control switch 7 is pressed, and the apparatus starts to generate steam instantaneously. The apparatus is then moved along the lock for administering a steam treatment, which is followed immediately by a straightening through contact with the treatment surfaces 31, 32 of the hair shaping device.

Because the controls of the device are independent from those of the apparatus, the latter can also be used with the straightening plates at ambient temperature or very slightly heated. This makes it possible to clean the lock, simultaneously ridding it of impurities and moisturizing it.

In a variant that is not shown in the drawings, the steam dispensing openings are located above the hair shaping device, in order to start with a straightening prior to the steam treatment.

Obviously, the invention is in no way limited to the embodiment described and illustrated, which was presented solely by way of an example. Modifications are possible, notably in terms of the constitution of the various elements or by substituting equivalent techniques, without exceeding the scope of protection for the invention in any way.

The invention claimed is:

1. A portable apparatus for the steam treatment of hair comprising:

a liquid tank, means for supplying liquid for a steam generator comprising a vaporization chamber in thermal contact with an electric heating element, the vaporization chamber communicating with one or a plurality of openings for dispensing steam to a lock of hair, and a hair shaping device comprising at least one treatment surface designed to come into contact with said lock of hair, characterized in that the generator is supplied with liquid by an electric pump, and wherein the vaporization chamber comprises a bottom plate equipped with a liquid intake opening and at least one outlet opening for the steam generated and a top plate, wherein the steam is made to circulate between the top plate and bottom plate by at least two paths formed by a plurality of baffles and the steam formed in the at least two paths is rejoined in a buffer zone formed between the baffles and a wall comprising the at least one outlet opening.

2. The apparatus as in claim 1, wherein the power of the electric heating element is in the range of between 600 W and 1000 W.

3. The apparatus as in claim 1, comprising one or a plurality of pipes in each case less than 3 cm long connecting the outlet from the vaporization chamber to the dispensing opening or openings.

4. The apparatus as in claim 1, comprising a control device for adjusting the flow rate of the liquid piped to the generator.

5. The apparatus as in claim 1, wherein the at least one treatment surface is generally elongate in shape and designed to come into contact with a lock of hair and further wherein said steam dispensing openings are adjacent to said hair shaping device.

6. The apparatus as in claim 5, wherein a steam path extends from a plurality of uniformly distributed openings aligned adjacent to the treatment surface of the hair shaping device in a direction perpendicular to the treatment surface of the hair shaping device.

7. The apparatus as in claim 5, wherein said dispensing openings are adjacent to the hair shaping device and are disposed upstream thereof.

8. The apparatus as in claim 5, wherein said dispensing openings are adjacent to the hair shaping device and are disposed downstream thereof.

9. The apparatus as in claim 1, wherein the hair shaping device has controls that are independent of controls for the steam.

10. The apparatus as in claim 5, further comprising a body that projects downward from the hair shaping device to form a handle, wherein the hair shaping device is oppositely arranged relative to the handle and the steam path exiting via the dispensing openings is directed along a longitudinal axis of the body.

11. The apparatus as in claim 5, wherein the liquid contained in the tank is a treatment product.

12. The apparatus as in claim 5, comprising a supplementary liquid tank adjacent to or associated with the hair shaping device.

13. The apparatus as in claim 12, wherein the liquid contained in the supplementary tank is different from the liquid contained in the tank for supplying the steam generator.

14. The apparatus as in claim 1, wherein the flow rate of the steam generated is in the range of between 10 g/min and 60 g/min.

15. The apparatus of claim 5, wherein the hair shaping device comprises two jointed arms displaceable in opposite directions, wherein each arm has a hair treatment surface and wherein at least one of the arms has a heating element in thermal contact with said treatment surface.

16. The apparatus as in claim 1, wherein the flow rate of the steam generated is greater than 5 g/min.

17. The apparatus as in claim 12, wherein the supplementary liquid tank is adapted to distribute liquid simultaneously with the liquid contained in the tank for supplying the steam generator.

* * * * *